US005454481A

United States Patent [19]

Hsu

[11] Patent Number: 5,454,481

[45] Date of Patent: Oct. 3, 1995

[54] INTEGRALLY BLOW MOLDED CONTAINER HAVING RADIAL BASE REINFORCEMENT STRUCTURE

[75] Inventor: Jui-Chang Hsu, Hsin Chu Hsien, Taiwan

[73] Assignee: Pan Asian Plastics Corporation, Taipei, Taiwan

[21] Appl. No.: 268,034

[22] Filed: Jun. 29, 1994

[51] Int. Cl.[6] ..... B65D 1/02

[52] U.S. Cl. ..... 220/608; 220/609

[58] Field of Search ..... 220/608, 609, 220/606; 215/1 C

[56] References Cited

U.S. PATENT DOCUMENTS

| | | | |
|---|---|---|---|
| 4,978,015 | 12/1990 | Walker | 220/608 |
| 5,071,015 | 12/1991 | Kinslow | 220/608 |
| 5,080,244 | 1/1992 | Yoshino | 220/608 |
| 5,287,978 | 2/1994 | Young et al. | 220/608 |
| 5,320,230 | 6/1994 | Hsiung | 220/608 |

*Primary Examiner*—Joseph Man-Fu Moy
*Attorney, Agent, or Firm*—Brumbaugh, Graves, Donohue & Raymond

[57] ABSTRACT

A container made from a synthetic resin, in particular, polyethylene terephthlate. The resin, after having been dried, is first injection molded into a preform like a test tube, and then softened by heating, and finally the required container is made by using the blow drawing technique in combination with a mold designed according the present invention for integrally blow molding containers having a radial base reinforcement structure. Said base reinforcement structure of the container comprises radially arranged enlarged feet, webs, and ribs, and a hub. In such a design, the hub extends outwardly into a radial configuration, with the enlarged feet supporting the weight of the bottle body, the portions between the feet serving as the webs, the feet and the webs being arranged alternately-relative to each other in the shape of a ring; the ribs engaging the front edges of the webs and recessed relative to the enlarged feet and extending smoothly to become the wall of the bottle, and arranged alternately relative to the enlarged feet also in the shape of a ring. In addition to providing good stability for the container to stand upright, the radial base reinforcement structure enhances the capability of withstanding the internal pressure and the impacts of external forces, thus preventing deformation and breakage of the bottle. Therefore, the container of the present invention is particularly suitable for use as bottles for carbonated beverages or as containers where reinforcement of the base structure is required.

5 Claims, 8 Drawing Sheets

INTEGRALLY BLOW MOLDED CONTAINER HAVING RADIAL BASE REINFORCEMENT STRUCTURE

FIELD OF THE INVENTION

The present invention relates to containers and, in particular, to such containers which are integrally blow molded and which have a radial base reinforcement structure.

BACKGROUND OF THE INVENTION

With the advancement in techniques for the production of plastics, containers made from plastic materials have been gradually replacing the glass containers used in the past due to the disadvantages of the fact that such glass bottles are fragile and relative heavy in weight, and under the considerations of safety, convenience and the shipping and production costs.

In view of environment protection, recycling of resources for reuse has become a common subject for all mankind. The present invention has thus provided a container which is made from a synthetic plastic, in particular, polyethylene terephthlate. A preform is first injection molded as a test tube, and the required container is obtained by designing suitable molds matching the desired shape of the bottle, and having the preform softened by heating (generally at temperatures between 90 and 110 degrees C.), and then the container is formed by means of blow extension.

The primary object of the present invention is to provide an integrally blow molded container made of a synthetic resin having a base reinforcement structure. Such a container, in addition to capable of standing upright stably without requiring the support by a bottom cup made from another material, can withstand the internal pressure in the bottle (in general, up to 5 kg/cm) and the impacts of external forces, thus preventing deformation and breakage of the container body. Moreover, the container of the present invention is integrally blow molded, thus avoiding the disadvantage of currently available containers, i.e., the difficulty in separating the different materials after the containers have been recovered, thus reducing the difficulties with recovery and processing of the bottles so as to achieve the advantage of easier recycling of resources for reuse.

The features and advantages of the present invention will become apparent from the comparison of the containers of the present invention with those designed according to conventional techniques.

BRIEF DESCRIPTION OF THE DRAWINGS

The differences between the present invention and the onventional techniques can be better understood from the following description taken in conjunction with the accompanying drawings, in which.

DETAILED DESCRIPTION OF THE PREFERRED EMBODIMENT

Figure 1:
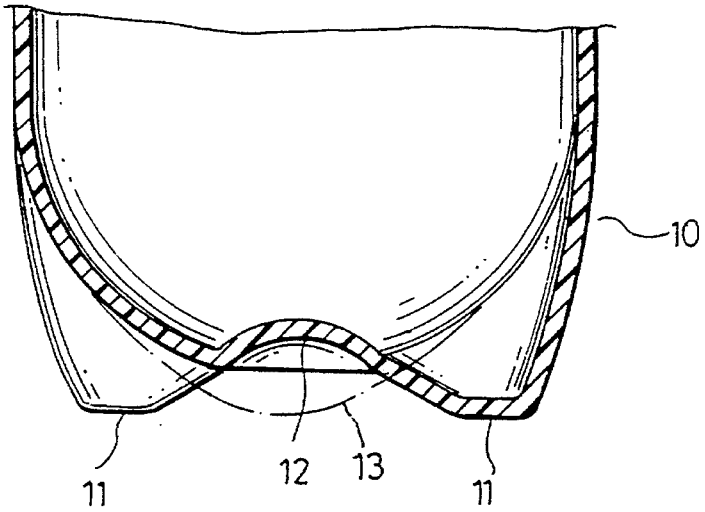
FIG. 1 PRIOR ART
FIG. 1 is a cross section view of the base of a conventional container.

Referring to FIG. 1, there is shown the base structure of a conventional integrally formed five-foot havng a recesses base, the base 10 comprising a supporting surface 11 for standing and a recessed portion 12. When filled with soft drinks containing carbon dioxide, the supporting surface 11 and the recessed portion can not withstand the internal pressure within the container, causing the base of the container to bulge outwardly under pressure as shown in phantom line 13. While the supporting surface 11 is designed to have a plurality of feet for standing and the profile of the feet provides crimped arcuate surface which helps to reinforce the bottom structure of the container and the bottle body to stand, in face, even though the recessed portion 12 is intensively reinforced along the inner side of the foot surfaces, the recessed portion 12 shown in FIG. 1 eventual will be unable to withstand the internal pressure and become bulged out with the result that the container can not stand stably and tends to tip over easily. Moreover, the bulged bottom is essentially subjected force unevenly at various points and cracks and bottle breakage occur easily at portions which are imperfectly drawn and hence weak in strength. Such a base structure is not suitable for containers having internal pressure but can be used only for containers without pressure when being filled, such as bottles for mineral water, soy bean sauce, seasonings, etc.

Figure 2:
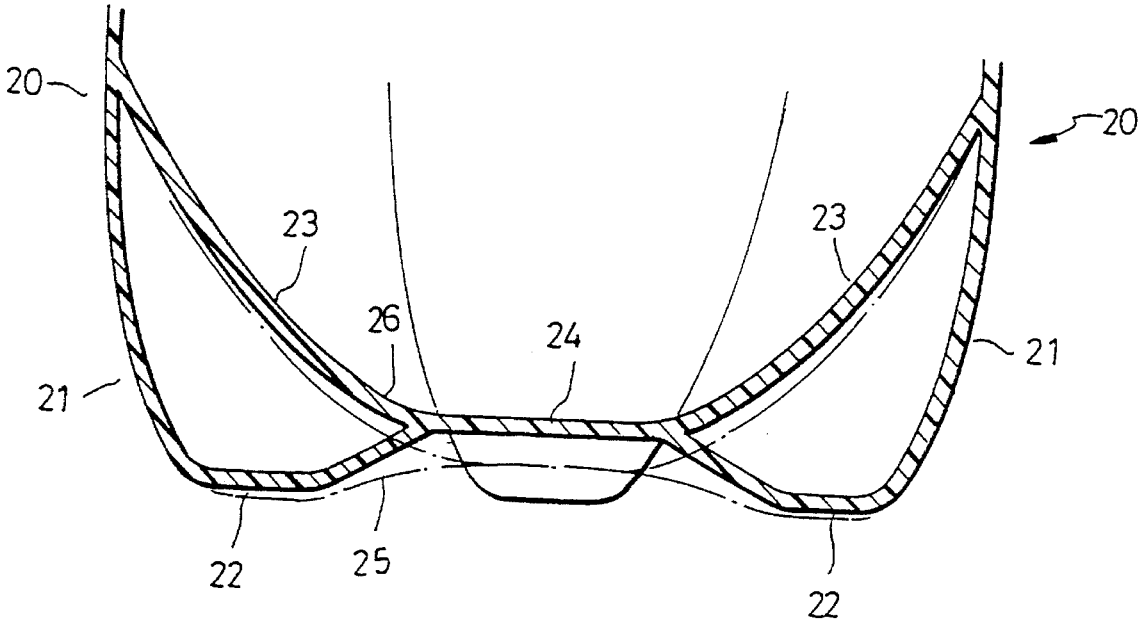
FIG. 2 PRIOR ART
FIG. 2 is a cross section view of the base of another conventional container.

Referring to FIG. 2, there is shown the base structure of another conventional integrally formed container having a base 20 comprising feet 21, a supporting surface 22 for standing, ribs 23, and a recessed hub 24. When such containers are filled with soft drinks containing carbon dioxide, the foot surfaces, the ribs, and the recessed hub can not withstand the internal pressure and will become bulged out as shown in phantom line 25. Such a base structure, with its reduced bottom area of the feet (i.e., reduced diameter of the circular area composed of the supporting feet) and reduced distance from the hub 24 of the recessed bottom to the supporting surfaces 22 for standing, has lowered stability for standing when being filled with contents under pressure such that the containers very easily become tipped over when being transported on a conveyor belt. Even placed still, they often can not stand up when being hit by a slight external force. Another adverse factor is that when such containers as shown in FIGS. 1 and 2 are used as bottles for soft drinks containing carbon dioxide and placed under circumstances of high temperature and humidity, cracks easily occur in the base due to the imperfect extension of the bottle base by blow molding. It is particularly so in places located in the subtropic zone such as Taiwan where the temperature in the summer season often rises to as high as above 35 degrees C. and the relative humidity may be well over 80%. In view of such conditions, soda water packed in plastic containers typically must be inspected every 12 weeks when stored at temperature of 22 degrees C. or every 4 weeks when stored at temperature of 35 degrees C., requiring that the penetration of the gas in the container should never exceed 15%. Therefore, the base 20 of the conventional containers as shown in FIG. 2 not only easily tend to crack, but also the cracks will gradually spread if stored in such circumstances for long period of time such that the gas penetration will accelerate. As a result, it will be impossible to maintain the standard of the products. Even worse, after the cracks have spread, the bottom of the bottle will break such that the contents will spill and other products stored in the same place will be affected.

In an attempt to solve the problem with the integrally formed containers filled with carbonated drinks which crack due to high internal pressure and high ambient temperature and humidity, the present invention provides a biaxial stretching plastic container which is an improvement of the conventional base structure as shown in FIGS. 1 and 2 and which will be described in detail hereinafter in conjunction with the drawings.

Figure 3:
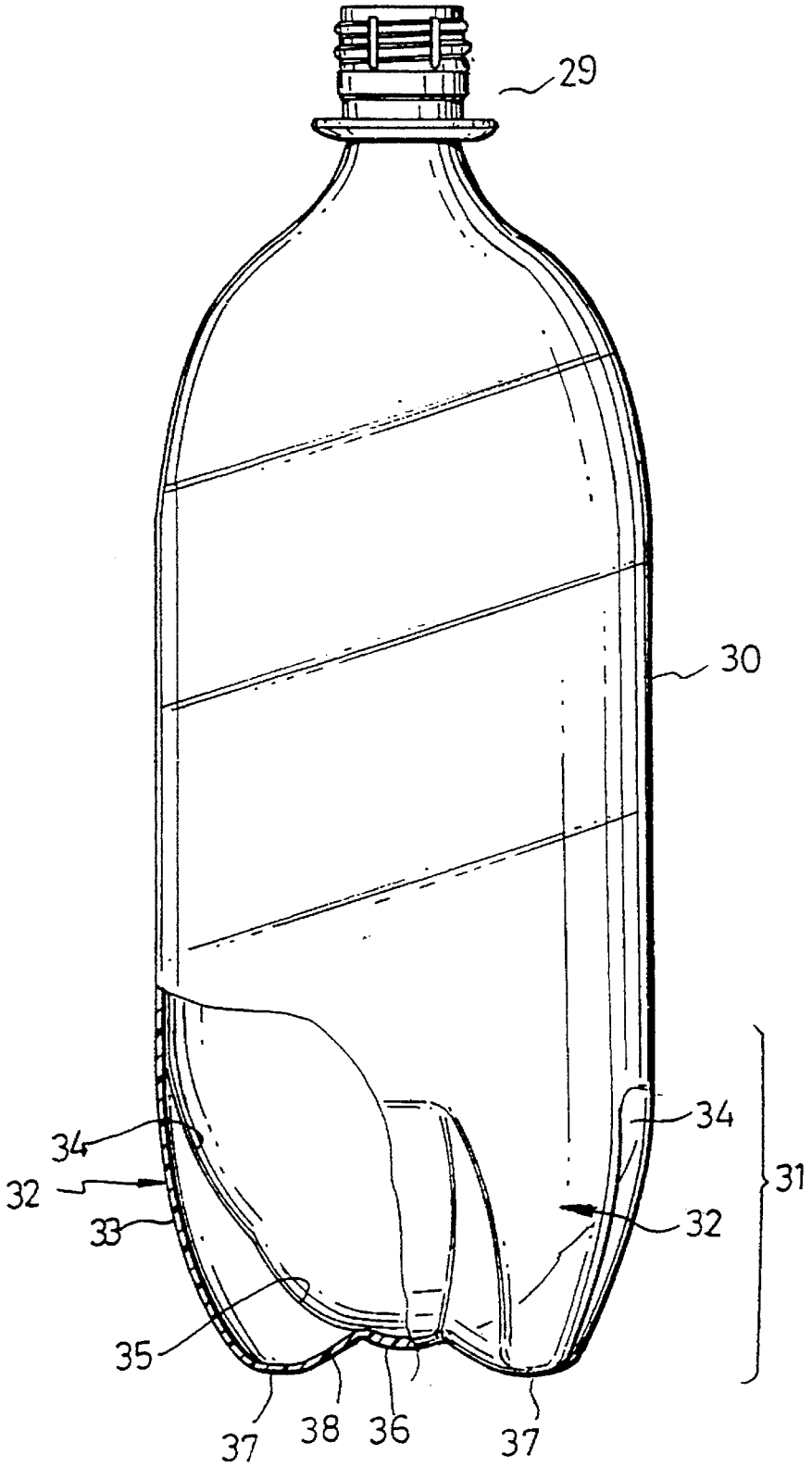
FIG. 3 is a side elevation view of the container (having five feet) of an embodiment according to the present invention.

As shown in the side elevation view of FIG. 3, an embodiment of the present invention is in the shape of a bottle suitable for holding carbonated drinks, the bottle comprising a mouth 29, a body 30, and a base 31, the mouth 29 having threads which mate with the threads on a cap so as to ensure that the contents in the container is prevented from leaking. Below the mouth is the bottle body 30 which is a hollow tubular body extending downwardly to be connected to the base 31.

As shown in FIG. 3, the base structure 31 of the present invention comprises five hollow enlarged bottle supporting feet 32, ribs 34, same number of webs 35 and a hub 36, the feet, the ribs, and the webs all extending outwardly in a radial ring shaped arrangement with the hub 36 as the center. As shown in FIG. 3, the outer wall of the base extends up toward the the bottle base in the shape of a dome, the apex of the dome being a slightly recessed round surface (approximating a spherical surface) which is the hub 36 as shown in FIG. 3.

Figure 4A:
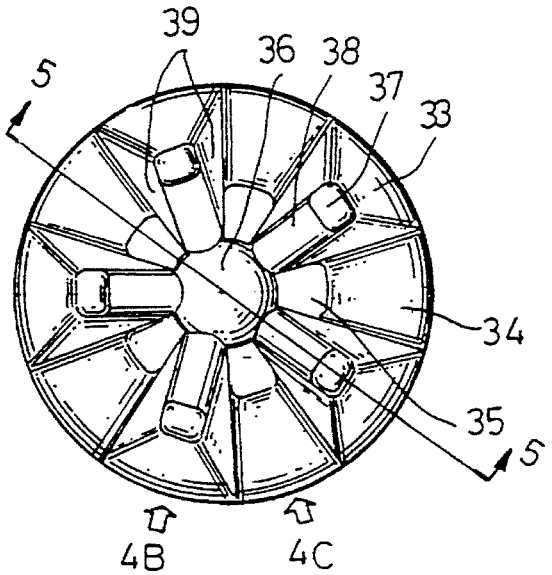
FIG. 4A is a bottom view of the container shown in FIG. 3.

In FIG. 4A, the bottom view of the present invention as shown in FIG. 3, the hub 36 has on its circumference the toes 38 of the enlarged feet 32 and the webs 35 disposed alternately relative to each in a ring shaped arrangement with the hub 36 as the center. The face of each of the feet has a toe 38, a sole 37, and two sides 39, wherein the the soles 37 serve to support the container in a standing postion, the rear edge smoothly extending up sharply to an ankle 33 which is approximately in the shape of an inverted triangle, and the front edge of each of the toes 38 being connected to the circumference of the hub 36. It is to be noted that although the soles are shown in the shape of a rectangle having rounded corners, they can be a trapezoid, a circle, or in other suitable shapes, and the soles 37 may have corners before being blow molded into shape because of the molds, and the corners will be smoothed out after blow molding. The face of each of the webs 35 is flat, short, and recessed between adjacent enlarged feet to be connected to the sides 39 of the feet, and the front edge of each of the webs 35 is also connected to the circumference of the hub. The ribs 34 are each engaged with the rear edge of the webs 35 and disposed alternately relative to the feet in a ring shaped arrangement and recessed relative to the enlarged feet 39 to be connected in parallel to the sides, the arcuated rib face being originated from the rear edge of the web and smoothly extending up sharply to form into the bottle body 30, and the ribs 34 being also disposed alternately relative to the feet in a ring shaped arrangement.

From the foregoing, the bottle bottom structure 31 of the present invention provides toes 38 and web 35 for the enlarged feet 32 in combination with the hub 36, enabling the bottle bottom structure 31 of the present invention to better withstand internal pressure and to prevent stress cracks due to insufficient extension of the container bottom portion from occurring.

Figure 4B:
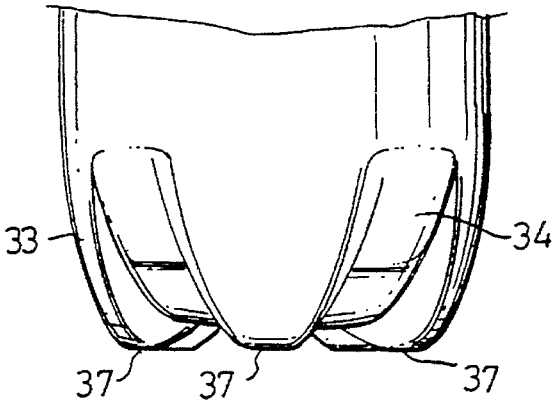
FIGS. 4B and 4C are side elevation views, respectively, of the bottom portion of the container of FIG. 3 as seen in the direction of FIG. 4A.
Figure 4C:
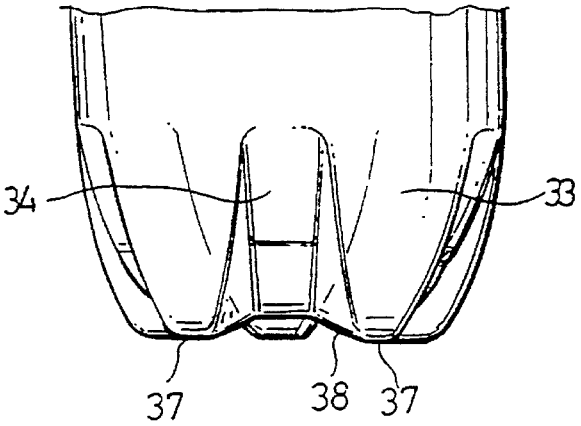

FIGS. 4B and 4C are side elevation views, respectively, of the bottom portion of the container of FIG. 3 as seen in the direction of FIG. 4A. It can be seen that the ribs 34 are interposed between the enlarged feet 32 and container is supported by the plane composed of the feet 32 and the soles 37. The ribs 34 extend downwardly to adjacent to the webs 35 and the webs 35 extends toward the hub 36 to be formed into projections between the hub 36 and the soles 37 in radial configuration and alternated with the soles 37 in ring shaped arrangement.

In order for the container of the present invention to better withstand the internal pressure, both the ribs 34 and the webs 35 are designed to be interposed between the enlarged feet and the faces of the ribs and the webs are required to have the largest possible width. According to tests and analysis, a width of 8 mm to 15 mm, for example, is most suitable for the 2 liter container for carbonated drinks.

Figure 5:
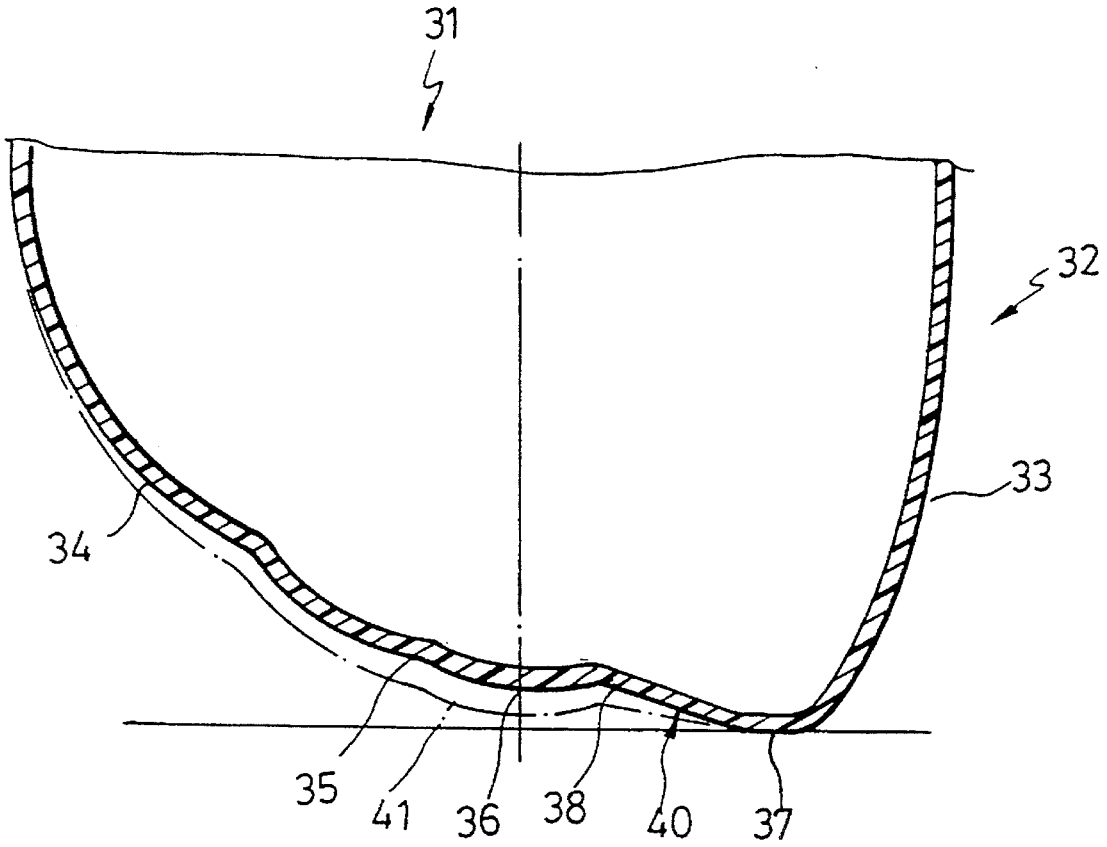
FIG. 5 is a cross section view taken along the line 5—5 in FIG. 4A.

Referring to FIG. 5, the cross section view of the presnet invention taken along line 5—5 of FIG. 4A, the features of the present invention will be better understood wherein the cross section 5—5 of the entire base is composed of the cross section lines of the ankles 33, the soles 37, the toes 38, the hub 36, the webs 35, and the ribs 34 which extend further up to the wall 31 of the container. According to a number of tests conducted with the present invention, the smooth continuous cross section composed of the angles 33, the soles 37, the toes 38, the hub 36, the webs 35, the ribs 34, and the wall 31 of the container is a continuous pressure resistant surface as shown in solid line 40 wherein the vertical distance from the central "point" of the hub 36 to the point on the plane where the enlarged feet stand is preferably 3 mm to 6 mm. On the cross section 5—5, the surface connecting the hub 36 and the toes 38 is a slant surface instead of an arcuate surface considering that in the arcuate surface design used in conventional technique, imperfect extention and thickness accumulation of the container wall may easily occur when internal pressure is generated after the container has been filled with gas, which may be avoided in a slant surface design. The webs 35 are designed to have an arcuated surface for increasing total surface area of the cross section and being engaged with the ribs 34 and the hub 36, which is desirable for respective continuous surfaces in the regions of the ribs 34, the webs 35, and the hub 36 to fully extend. In contrast, in conventional technique, there exists only one arcuate surface of the rib, which naturally causes imperfect extension to occur very easily. The above cross section design is particularly capable of preventing the stress cracks due to imperfect extension from occurring in the position of the "hub" where the pouring gate of the test tube shaped preform (the feeding gate for injecting the preform) is located.

According to another feature of the present invention as shown in solid line 40 in FIG. 5, after the container has been filled with carbon dioxide, the base will become bulged as shown in phantom line 41. While the base of the container bulges slightly, the area for the base of the container to stand will not be affected, that is, in addition to the soles 37 engaging the standing surface, there are sufficient gaps between the toes 38 and the standing plane to form into supporting surfaces to facilitate stable standing. Regardless of the fact that the flatter the base is, the easier it is for the container to stand, actually it is extremely difficult for the thin wall of the container not to become bulged and to maintain flat such that the container can stand. It is rather practical to have the base formed with a plurality of foot shaped supporting surfaces which serve the purposes for both standing and pressure resistance. Therefore, the container will not become tipped over when transported on the conveyor belt and can stand stably when placed on the shelf, which meets the requirements in practice.

Figure 6:
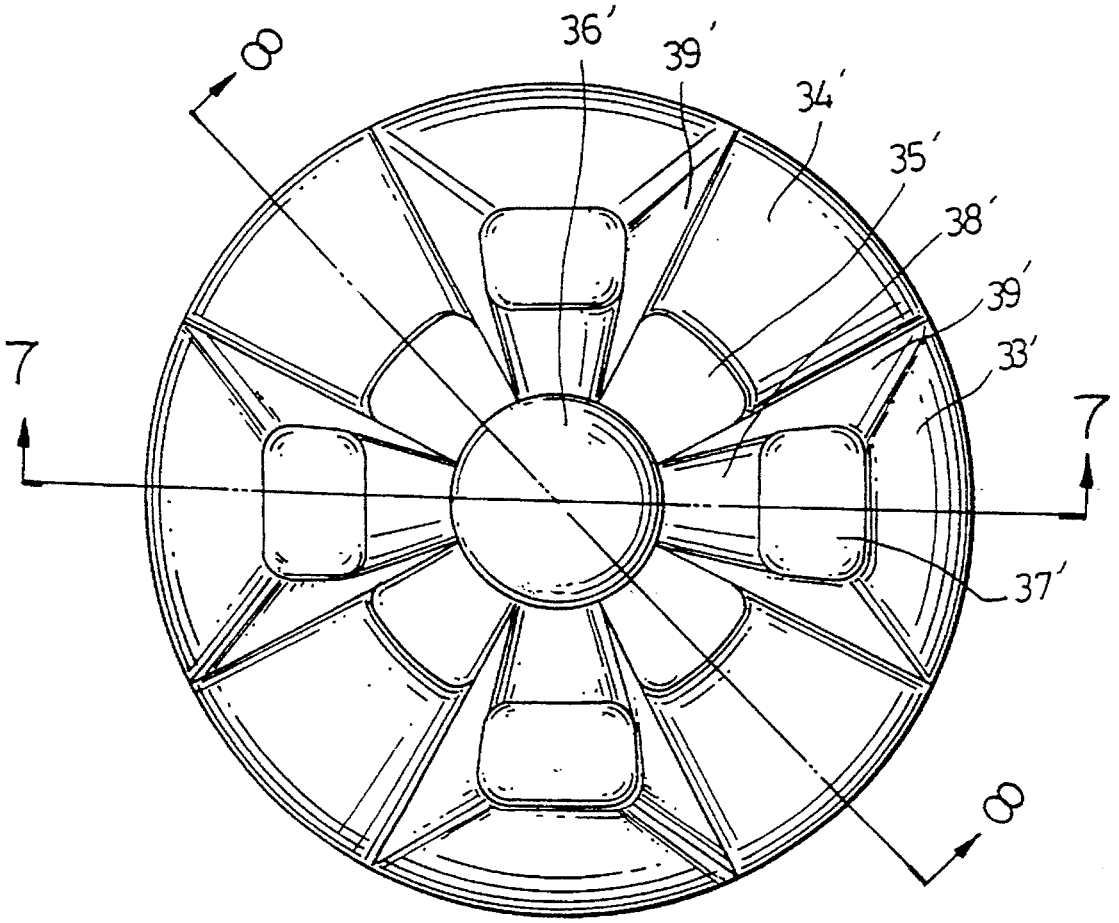
FIG. 6 is a bottom view of the container (having four feet) of another embodiment of the present invention.

As shown in FIG. 6, the present invention can be disposed in a four foot configuration. The hub 36' has on its circumference the toes 38' and the webs 35' disposed alternately relative to each in a ring shaped arrangement with the hub 36' as the center. The face of each of the feet has a toe 38', a sole 37', and two sides 39', wherein the the soles 37' serve to support the container in a standing postion, the rear edge smoothly extending up sharply to an ankle 33' which is approximately in the shape of an inverted triangle, and the front edge of each of the toes 38' being connected to the circumference of the hub 36'. It is to be noted that although the soles are shown in the shape of a rectangle having rounded corners, they can be a trapezoid, a circle, or in other suitable shapes, and the soles 37' may have corners before being blow molded into shape because of the molds, and the corners will be smoothed out after blow molding. The face of each of the webs 35' is flat, short, and recessed between adjacent enlarged feet to be connected to the sides 39' of the feet, and the front edge of each of the webs 35' is also connected to the circumference of the hub. The ribs 34' are each engaged with the rear edge of the webs 35' and disposed alternately relative to the feet in a ring shaped arrangement and recessed relative to the enlarged feet 39' to be connected in parallel to the sides, the arcuated rib face being originated from the rear edge of the web and smoothly extending up sharply to form into the bottle body 30, and the ribs 34' being also disposed alternately relative to the feet in a ring shaped arrangement.

Figure 7:
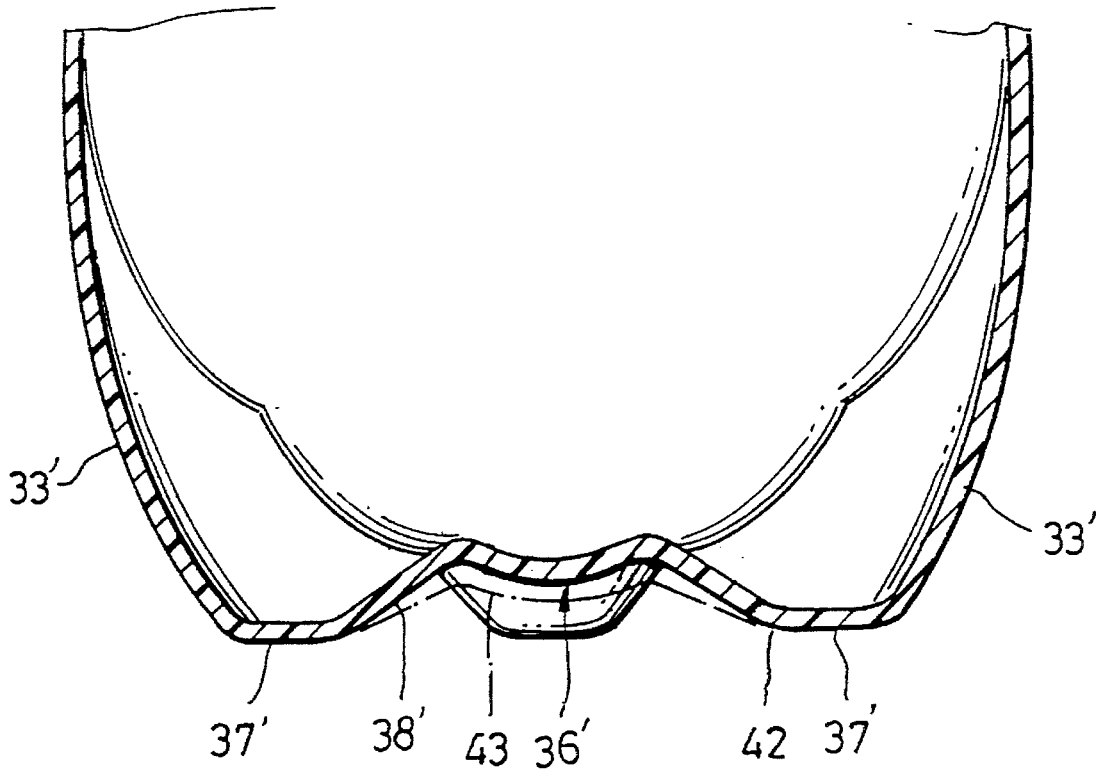
FIG. 7 is a cross section view taken along the line 7—7 in FIG. 6.
Figure 8:
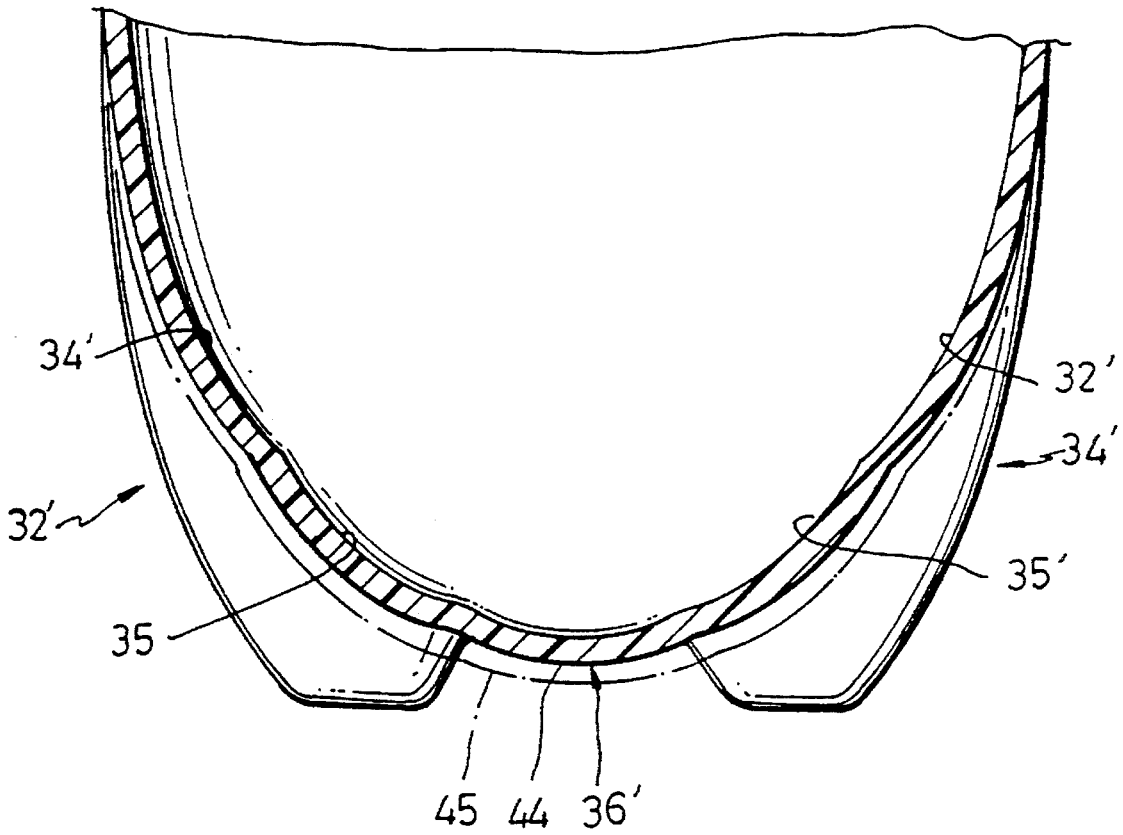
FIG. 8 is a cross section view taken along the line 8—8 in FIG. 6.
Figure 9:
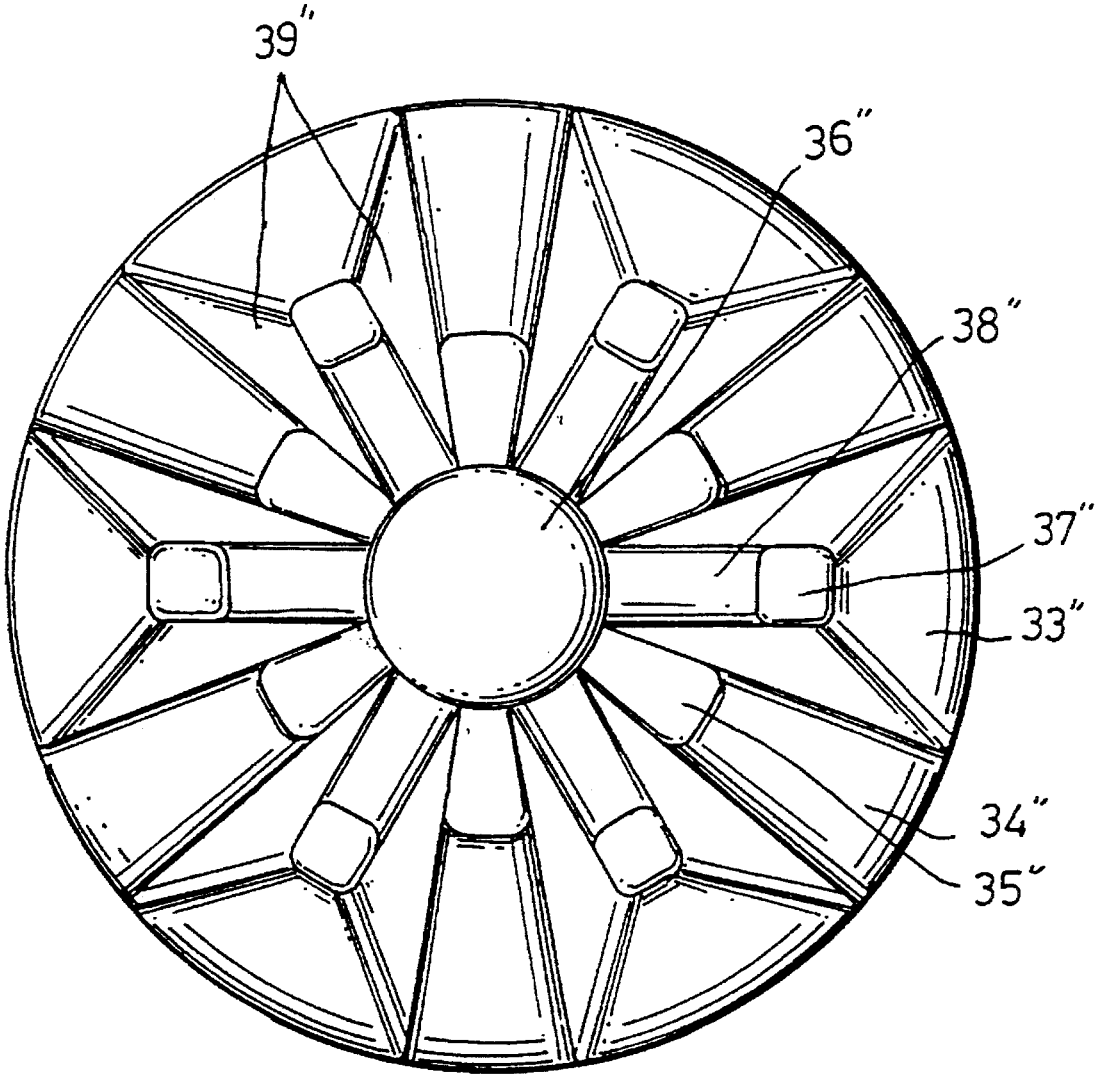
FIG. 9 is a bottom view of the container (having six feet) of still another embodiment of the present invention.

Referring to FIG. 7, the cross section view of the presnet invention taken along line 7—7 of FIG. 6, the features of the second embodiment of the present invention will be better understood wherein the cross section 7—7of the entire base is composed of the cross section lines of the ankles 33' the soles 37', the toes 38', the hub 36', the toes 38', the soles 37', and the toes 33', which extend further up to the wall 31' of the container. According to a number of tests conducted with the present invention, the smooth continuous cross section composed of the angles 33', the soles 37', the toes 38', the hub 36', the toes 38', the soles 37', and the toes 33', is a continuous pressure resistant surface as shown in solid line 42. Referring to FIG. 8, the cross section view of the presnet invention taken along line 8—8 of FIG. 6, the features of the second embodiment of the present invention will be better understood the cross section 8—8 of the entire base is composed of the other cross section lines of the ribs 34', the webs 35', the hub 36', the webs 35', the ribs 34', which extend further up to the wall 31' of the container. According to a number of tests conducted with the present invention, the smooth continuous cross section composed of the ribs 34', the webs 35', the hub 36', the webs 35', the ribs 34' is a continuous pressure resistant surface as shown in solid line 42, wherein the vertical distance from the central "point" of the hub 36 to the point on the plane where the enlarged feet stand is preferably 3 mm to 6 mm. On the cross section 7—7, the surface connecting the hub 36' and the toes 38' is a slant surface instead of an arcuate surface considering that in the arcuate surface design used in conventional technique, imperfect extention and thickness accumulation of the container wall may easily occur when internal pressure is generated after the container has been filled with gas, which may be avoided in a slant surface design. The webs 35' are designed to have an arcuated surface for increasing total surface area of the cross section and being engaged with the ribs 34' and the hub 36', which is desirable for respective continuous surfaces in the regions of the ribs 34', the webs 35', and the hub 36', to fully extend. In contrast, in conventional technique, there exists only one arcuate surface of the rib, which naturally causes imperfect extension to occur very easily. The above designs of cross section 7—7and 8—8 are particularly capable of preventing the stress cracks due to imperfect extension from occurring in the position of the "hub" where the pouring gate of the test tube shaped preform (the feeding gate for injecting the preform) is located.

Also, the present can be disposed in a six foot configuration wherein there is formed a smooth pressure reistant surface similar to that of the four foot configuration as shown in FIG. 6. The continuous pressure resistant surface can be in a foot symmetrical and rib symmetrical arrangement, the features of which can be known from the description of FIGS. 6–8 and hence are not further explained.

According to a common feature of the embodiment of the present invention, after the container has been filled with carbon dioxide, the base will become bulged as shown in solid line 40 to phantom line 41 in FIG. 5, solid line 42 to phantom line 42 in FIG. 7, and solid-line 44 to phantom line 45 in FIG. 8. While the base of the container bulges slightly, the area for the base of the container to stand will not be affected, In each of the embodiments, the soles each can engage the standing plane and there are sufficient gaps formed between the toes and the standing plane to facilitate stable standing.

While the preferred embodiment has been described in detail, it should be understood that the present invention is not limited to the exact structure and method as described hereinbefore. Various changes and modifications can be made without departing from the spirit and scope as set forth in the appended claims.

I claim:

1. A base structure for a container for soft drinks having a tubular side wall of a first diameter which is connected to a bottle body, said base structure comprising:

a hub having a substantially flat circular surface;

a plurality of enlarged feet extending downwardly and radially inwardly from said bottle body and terminating at said hub, the base of each of said feet forming into a sole, said soles constituting discrete supporting surfaces having a second diameter smaller than said first diameter; and a plurality of ribs between said feet extending downwardly and radially inwardly from said bottle body in a more prominent manner and terminating at said hub, the base of each of said ribs forming a web, said webs being interposed between said soles such that when the supporting surfaces comprising said soles support the container on a horizontal plane, said webs being above said horizontal plane and said webs forming into a discrete circle having a third diameter smaller than the second diameter;

said hub having on its circumference said enlarged feet and said webs, which are disposed alternately relative to each other in a ring shaped arrangement with the hub as the center.

2. The base structure as set forth in claim 1, wherein said enlarged feet each include a sole, a toe and two sides and said toes being connected to the hub to be a slant surface which may avoid cracks occurring due to stress concentration.

3. The base structure as set forth in claim 1, wherein said webs are each designed to have an arcuated surface serving to be engaged with the ribs and the hub, which is desirable for the continuous surface formed of the ribs, the webs, and the hub to extend.

4. The base structure as set forth in claim 1, wherein said enlarged feet and said ribs are disposed alternately relative to each other and surround adjacent said hub with the feet being opposed to the ribs so as to form into a continuous smooth surface by the extension of the enlarged feet, the hub, the webs and the ribs.

5. The base structure as set forth in claim 1, wherein said enlarged feet and said ribs are disposed alternately relative to each other and surround adjacent said hub with the feet being opposed to feet and the ribs being opposed to ribs so as to form into a continuous smooth surface by the extension of the enlarged feet, the hub, the enlarged feet in a foot symmetrical configuration and a continuous smooth surface by the extension of the ribs, the webs, the hub, the ribs, the webs in a rib symmetrical configuration.

* * * * *